United States Patent [19]

Yuen

[11] 4,189,671

[45] Feb. 19, 1980

[54] VOLTAGE REGULATOR AND REGULATOR BUFFER

[75] Inventor: Raymond C. Yuen, Poway, Calif.

[73] Assignee: Burroughs Corporation, Detroit, Mich.

[21] Appl. No.: 893,207

[22] Filed: Apr. 3, 1978

[51] Int. Cl.[2] ..... G05F 5/00

[52] U.S. Cl. ..... 323/19; 323/1; 323/8

[58] Field of Search ..... 307/310, 218, 296, 297; 323/1, 4, 8, 9, 22 T, 19, 68, 69, 16

[56] References Cited

U.S. PATENT DOCUMENTS

| | | | |
|---|---|---|---|
| 3,970,876 | 7/1976 | Allen et al. | 307/310 |
| 4,017,788 | 4/1977 | Stepp et al. | 323/22 T |
| 4,091,321 | 5/1978 | Hanna | 323/19 |
| 4,100,477 | 7/1978 | Tam | 323/8 |
| 4,100,478 | 7/1978 | Tam | 323/19 |
| 4,110,677 | 8/1978 | Boronkay et al. | 323/19 |

OTHER PUBLICATIONS

Natl. Semiconductor Corp Application Note AN-42, 1971, pp. 1-6.

*Primary Examiner*—William M. Shoop

*Attorney, Agent, or Firm*—Joseph R. Dwyer; Kevin R. Peterson

[57] ABSTRACT

A voltage regulator and regulator buffer having a plurality of matched transistors including an output transistor arranged such that the fluctuation in supply voltage is sensed by a shunt circuit which tracks such voltage fluctuation and eliminates such fluctuations from the output transistor by causing current variations due to supply voltage variations to flow through another transistor connected in parallel with the output transistor thus eliminating the first order effects of power supply voltage variations on output voltage. The voltage regulator buffer comprises a plurality of matched transistors which also has a voltage supply variation shunt circuit similar to the regulator shunt circuit to regulate the current through an output transistor thus eliminating the effect of the power supply voltage thereon and providing an output voltage of a precise amount.

6 Claims, 1 Drawing Figure

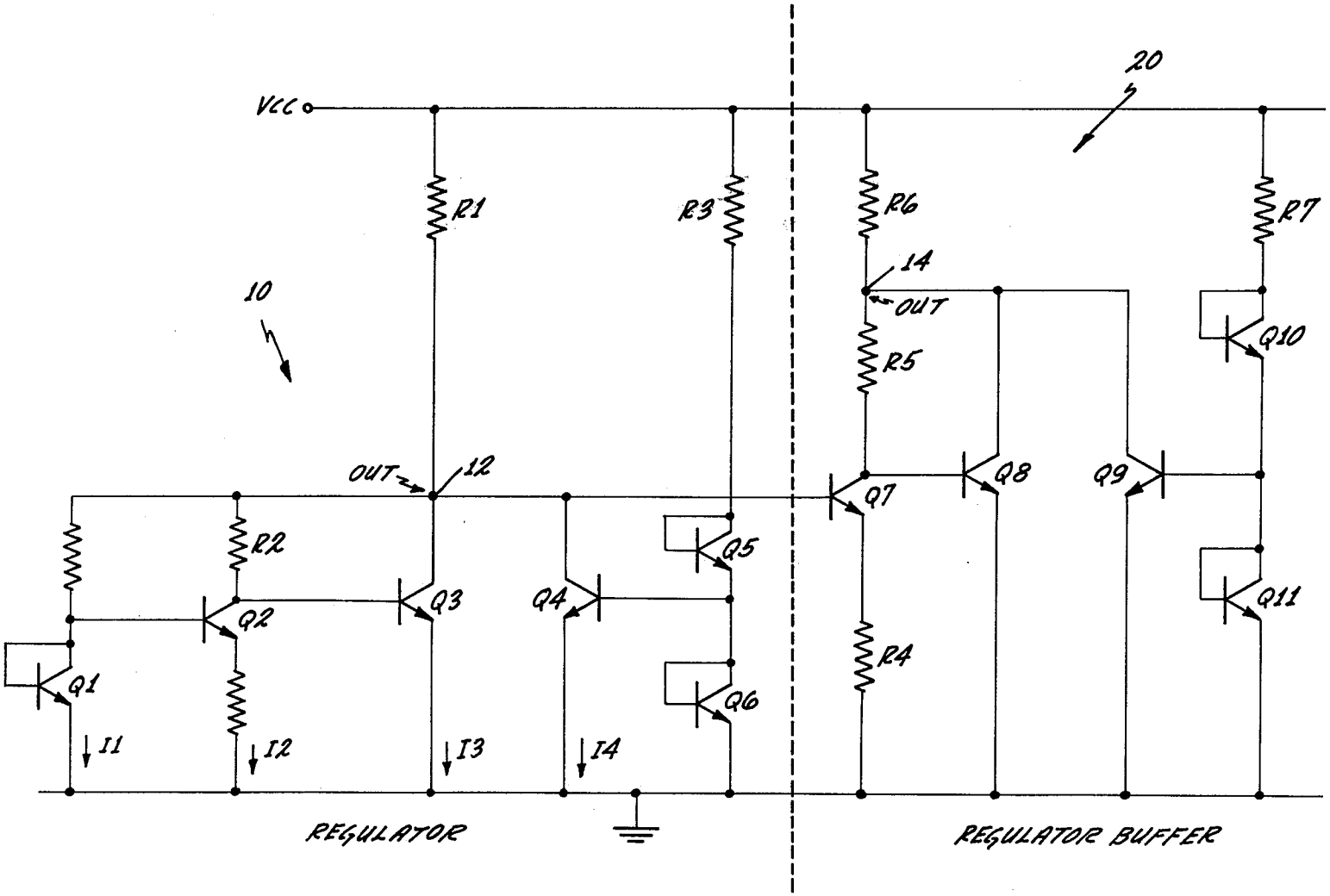
R7
Q10
Q11
20
Q9
Q8
R6
14
OUT
R5
Q7
R4
REGULATOR BUFFER
R3
Q5
Q6
Q4
I4
R1
12
Q3
I3
OUT
REGULATOR
VCC
10
R2
Q2
I2
Q1
I1

VOLTAGE REGULATOR AND REGULATOR BUFFER

BACKGROUND OF THE INVENTION

This invention relates, in general, to voltage regulators and regulator buffers in integrated circuitry technology and, in particular, to voltage regulators and regulators buffers for CML devices.

Voltage regulators have been developed to supply a constant output voltage for logic circuits within a limited range of variations in the supply voltage. One prior art regulator circuit utilizes a resistor between the power supply voltage and the base of a shunt transitor to compensate for variations in the supply of voltage. Since such a resistor is also subject to supply voltage variations, it does not completely eliminate the first order effect of the voltage variations on the shunt transistor. Consequently, the output voltage of the regulator is not constant. This prior art circuit is shown in the U.S. Pat. to Allen, et al, No. 3,970,876.

Another prior art regulator circuit uses a supply feedback amplifier coupled to the shunt transistor of the voltage regulator. The resistances of the supply feedback amplifier are carefully matched to the resistances in the regulator so that a fluctuation in supply voltage is sensed by the supply feedback section to maintain current through the shunt transistor constant thus providing a regulated voltage output. This circuit is shown in the application for U.S. patent by R. K. Tam, Ser. No. 745,660, filed Nov. 29, 1976, now U.S. Pat. No. 4,100,477. However, this circuit also required an additional feedback from an unbalancing circuit to the output node.

Another approach in the prior art is to eliminate the effect of the shunt transistor from the regulator entirely by utilizing pairs of transistors with matched current densities and high current gains to supply a constant output voltage. This circuit is shown in the application for U.S. patent, Ser. No. 772,767 by R. K. Tam, filed Feb. 28, 1977, now U.S. Pat. No. 4,100,478.

Finally, it should be pointed out that while the prior art Stopper regulator was invented for power supplies at 2.7±30% and the two Tam regulators were invented for voltages of 4.8 V±25%, still a need exists for a regulator and regulator buffer which will operate better at 2.7 V±30% ie. over a range of 3.5 V to 1.9 V without being affected by such voltage fluctuations as mentioned above.

Accordingly it is a primary object of this invention to provide a regulator which is fully compensated for supply voltage variation by eliminating such effects on the current flow through a main or output transistor.

A further object of this invention is to provide a regulator with shunt circuitry which includes circuit means for tracking any variation in supply voltage and causing one transistor coupled in parallel with an output transistor to shunt current from the flow path through the output transistor thus providing a constant voltage output from the regulator.

Still another object of this invention is to provide a regulator buffer connected to the output of this same regulator and to the same supply voltage for providing a constant voltage output for series gated CML devices.

Still another and more specific object of this invention is to provide a regulator and regulator buffer operable with a power supply voltage of 2.7 V±30%.

SUMMARY OF THE INVENTION

The voltage regulator and regulator buffer circuit which accomplishes the foregoing objects comprises a plurality of matched transistors, one of which is an output transistor all providing current paths from a positive supply voltage to a reference voltage. Another of said transistors being coupled to circuitry which is connected to the supply voltage and to said reference voltage for tracking variations in the supply voltage and causing the latter transistor to shunt variations in current due to supply voltage variations therethrough instead of through the output transistor, thus eliminating a first order effects on current by the supply voltage variations on the output transistor. The regulator buffer circuit is coupled to the output of said regulator and to the same power supply and comprises an output transistor and a second transistor forming a current path between the power supply voltage and the reference voltage which second transistor, in turn, is coupled to a supply voltage tracking circuit to shunt the fluctuations in current through said second transistor instead of through the output transistor, thus providing a precise voltage output from the regulator buffer.

BRIEF DESCRIPTION OF THE DRAWING

The sole FIGURE in the accompanying drawing discloses the preferred embodiment of this invention.

BRIEF DESCRIPTION OF THE PREFERRED EMBODIMENT

In the single FIGURE, all circuit elements and their connections are deposited on a chip to form a part of an IC.

In the drawing, the regulator circuit 10 is coupled to a regulator buffer 20 and the purpose of the regulator circuit is to maintain the voltage at output node 12 at a constant voltage, typically 1.2 V, regardlss of variations in the voltage supply VCC, typically 1.9 V. The purpose of the regulator buffer circuit 20 is to lower the voltage at its output node 14 to precise value, typically 1.0 V, to allow more transistors to be used in series gating for CML.

Also, it should be understood that this embodiment is directed to voltage compensation for variations of voltage supply and to simplify the understanding of the embodiment all circuitry for temperature compensation, being well known in the art, has been omitted.

The output node 12 of the regulator 10 is connected to VCC through resistor R1 and is connected to the collectors of transistors Q1, Q2, Q3 and Q4 whose emitters are all connected to a reference voltage source, such as ground. The base of the transistor Q1 is shorted to its collector and the collector in turn is connected to the base of transistor Q2. The collector of transistor Q2 is connected to the base of Q3 and through a resistor R2 to the output node 12, as aforesaid, and the base of transistor Q4 is connected midway between transistors Q5 and Q6. Transistors Q5 and Q6 have their respective bases shorted to their respective collectors and the collectors of transistor Q5 is connected to VCC through resistor R3. The emitter of transistor Q5 is connected to the collector of transistor Q6 which, in turn, has its emitter connected to ground.

Thus, current flow through resistor R1 to the output node 12 is branched into three current paths I1, I2, I3 and I4 through transistors Q1, Q2, Q3 and Q4 respectively. There is, of course, a current path from node 12 which is directly connected to ground or reference potential through transistor Q7 of the regulator buffer 20 but, due to the high impedence base connection of transistor Q7, the current flow through transistor is neglible.

Before describing the operation of the regulator circuit 10, it should be noted that the resistance values of the resistors R1 and R3 are equal and the transistors Q3, Q5 and Q6 are matched so that the VBE of Q3, Q5 and Q6 are equal.

The operation of the regulator and the voltage output at node 12 can best be described from the following where ICQ2 is the collector current through transistor Q2 and VOL is equal to ICQ2 times R2 so that in the following formula:

$$\text{Output Regulator} = VBEQ3 + ICQ2 \times R2 = VBEQ3 + VOL$$

where $VOL = ICQ2 \times R2$ and ICQ2 is the collector current through transistor Q2, $$IQ3 = \frac{VCC - VOL - VBEQ3}{R1} - \frac{(VCC - VBQ5 - VBEQ6)}{R3} - IQ1 - IQ2$$

Note in the foregoing that current in transistors Q1 and Q2, having the same VBE as Transistor Q3, will also have a constant current in this circuitry, that is, I1 equals I2. Also current through transistor Q4 is equal to the current flow through transistor Q6 since the VBE of transistors Q4 and Q6 are matched. Now since resistors R1 and R3 are equal and since the VBEs of transistors Q5, Q6 and Q3 are equal, then by substitution, the current IQ3 becomes the expression:

$$\begin{aligned} IQ3 &= \frac{VCC - VOL - VBEQ3}{R1} - \frac{(VCC - VBEQ3 - VBEQ3)}{R1} - IQ1 - IQ2 \\ &= \frac{VCC - VOL - VBEQ3 - VCC + VBEQ3 + VBEQ3}{R1} - IQ1 - IQ2 \\ &= \frac{VBEQ3 - VOL}{R1} - IQ1 - IQ2 \end{aligned}$$

It is to be noted from the foregong that the current 1Q3 is not a function of any voltage variations at VCC. It is simply a function of the VBE Q3, VOL. It should also be noted that regardless of any differences in VBE of Q1 VBE of Q2, the current through transistors Q1 and Q2 will remain constant. Further, transistor Q4 acts as part of the shunt circuitry to sink any variation in the current through resistor R3 so that the current through transistor Q3 will remain constant. Thus, with transistor Q4 acting to shunt current variations, such variations will have only a second order effect on the output of the regulator.

Turning now to the regulator buffer 20, the aforementioned transistor Q7 has its base connected to the output node of 12 of the regulator 10 and its emitter connected through resistor R4 to ground. The collector of transistor Q7 is connected through resistor R5 and resistor R6 to VCC and in common to the base of transistor Q8. Transistor Q8 has its emitter connected directly to ground and its collector connected midway to resistors R5 and R6 at output node 14 and in common to the collector of transistor Q9. The emitter of transistor Q9 is connected directly to ground and its base is connected between two series connected transistors Q10 and Q11. Transistors Q10 and Q11 each have its base shorted to the collectors to form a diode and the emitter of Q11 is connected directly to ground while the emitter of Q10 is connected to the collector of Q11 and the base of Q9 and its collector is connected through resistor R7 to VCC.

As hereinabove mentioned, the purpose of the regulator buffer circuit 20 is to lower the voltage of the output node 14 to a precise value to allow more transistors to be used in series gating for current mode logic, i.e., allowing more logic functions to be performed by putting an extra layer of transistors in the series gating arrangement.

In this buffer, the transistors are matched, transistor Q7 matches transistor Q3, and the resistance value of R4 is twice R5, therefore, the operation of the regulator buffer 20 is similar to the operation of the regulator 10 and can best be understood from the following formula:

$$\text{Out (Regulator)} = VBEQ3 + VOL$$
$$\text{Out} - VBEQ7 - VR4 = 0$$
$$VOL - VR4 = 0$$
$$VOL = VR4$$
$$IR4 = \frac{VOL}{R4}$$
$$\text{Out (Regulator Buffer)} = VBEQ8 + VR5$$
$$ICQ7 \approx IR4 = VBEQ8 + (ICQ7) \times (R5)$$
$$\text{If } R5 = \tfrac{1}{2} R4 = VBEQ8 + \frac{VOL}{R4} \times R5 = VBEQ8 + \frac{VOL}{R4} \times \tfrac{1}{2} R4 = VBEQ8 + \frac{VOL}{2}$$

From the foregoing it can be seen that there is disclosed a regulator and a regulator buffer particularly adaptable for CML Logic Devices where the VBE of the transistors is approximately 800 millivolts and the voltage swings between logic 1s and logic 0s is approximately 400 millivolts so that this regulator is particularly useful with a 1.9 volt power supply with a regulator output being 1.2 volts and the output from the voltage regulator buffer being 1.0 volts.

What is claimed:

1. A voltage regulator which compensates for variations in power supply voltage of 2.7 V±30% between said power supply and a reference voltage and which supplies CML devices with a constant voltage, comprising:

a plurality of matched transistors connected in parallel with each other but connected in series between said power supply voltage and said reference voltage so as to provide paths of equal current therebetween, an output node and resistance means in series between said transistors and said power supply voltage, circuit means including a pair of transistors connected in series between said power supply voltage and said reference voltage so as to be responsive to variations in supply voltage, the base of one of said plurality of transistors being connected between said pair of transistors whereby said one transistor is responsive to voltage variations in said circuit means and will shunt variations in current due to the variations of power supply voltage through said one transistor holding the current through the other of the plurality of transistors constant so that the voltage at said output node is held constant.

2. The voltage regulator as claimed in claim 1 wherein said plurality of matched transistors include four NPN transistors whose collectors are connected in common to said output node, and whose emitters are connected in common to said reference voltage, the first of said four transistors has its collector also shorted to its emitter and also connected to the base of the second of said four transistors, and the second of said four transistors has its collector connected to the base of the third transistor of said four transistors.

3. The voltage regulator as claimed in claim 2 further including resistance means connected between said pair of transistors and power supply voltage and wherein said pair of transistors are NPN transistors with the collector of one of said pair connected to said last mentioned resistance means and to its base and wherein the second of said pair has its collector connected to the emitter of said one of said pair and to its base and wherein the emitter of said second transistor of said pair is connected to reference voltage.

4. The regulator as claimed in claim 1 further including a regulator buffer in combination therewith comprising;

a buffer output node, a first transistor connected in series between said power supply voltage and said reference voltage, the base of said first transistor being connected to the output node of said regulator, a pair of resistance means connected between said first transistor and said power supply voltage, a first pair of transistors connected in parallel with said first transistor and in series with said supply voltage, reference voltage, and one of said resistance means, and circuit means including a second pair of transistors connected in series between said power supply voltage and said reference voltage so as to be responsive to variations in power supply voltage, the base of one of said first pair of transistors being connected between said second pair of transistors, whereby said one of said first pair of transistors is responsive to voltage variations in said circuit means and will shunt current therethrough holding the current through said first transistor constant so that the voltage in said buffer output node is held constant.

5. The regulator as claimed in claim 3 further including a regulator buffer in combination therewith, comprising:

a buffer output node, a first transistor connected in series between said power supply voltage and said reference voltage, the base of said first transistor being connected to the output node of said regulator, a pair of resistance means connected between said first transistor and said power supply voltage, a first pair of transistors connected in parallel with said first transistor and in series with said supply voltage, reference voltage, and one of said resistance means, and circuit means including a second pair of transistors connected in series between said power supply voltage and said reference voltage so as to be responsive in variations in power supply voltage, the base of one of said first pair of transistors being connected between said second pair of transistors, whereby said one of said first pair of transistors is responsive to voltage variations in said circuit means and will shunt current therethrough holding the current through said first transistor constant so that the voltage in said buffer output node is held constant.

6. The regulator and regulator buffer as claimed in claim 5 wherein all of the transistors of said buffer are NPN transistors and wherein the emitter of said first transistor is connected to reference voltage through a third resistance means and its collector is connected to the buffer output node through one of said pair of resistance means, and wherein the collectors of said first pair of transistors are connected to said buffer output node and wherein first transistor of said second pair of transistors has its collector connected to power supply voltage and its emitter connected to the collector of the second transistor of said second pair, and wherein the collector of said second transistor of said second pair is connected to its base and its emitter is connected to reference voltage.

* * * * *